US009733600B2

(12) United States Patent
Nozawa et al.

(10) Patent No.: US 9,733,600 B2
(45) Date of Patent: Aug. 15, 2017

(54) FIXING DEVICE AND IMAGE FORMING APPARATUS

(71) Applicants: Kenji Nozawa, Kanagawa (JP); Masami Okamoto, Kanagawa (JP); Yuuki Kikushima, Kanagawa (JP); Keisuke Kubota, Kanagawa (JP); Shuutaroh Yuasa, Kanagawa (JP); Kaori Hemmi, Kanagawa (JP)

(72) Inventors: Kenji Nozawa, Kanagawa (JP); Masami Okamoto, Kanagawa (JP); Yuuki Kikushima, Kanagawa (JP); Keisuke Kubota, Kanagawa (JP); Shuutaroh Yuasa, Kanagawa (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/069,457

(22) Filed: Mar. 14, 2016

(65) Prior Publication Data

US 2016/0306306 A1 Oct. 20, 2016

(30) Foreign Application Priority Data

Apr. 17, 2015 (JP) ..... 2015-085297

(51) Int. Cl.
*G03G 15/20* (2006.01)

(52) U.S. Cl.
CPC . *G03G 15/2053* (2013.01); *G03G 2215/0129* (2013.01); *G03G 2215/2032* (2013.01)

(58) Field of Classification Search
CPC ..... G03G 15/2053; G03G 15/206; G03G 2215/0129; G03G 2215/20324
See application file for complete search history.

(56) References Cited

U.S. PATENT DOCUMENTS 6,088,558 A * 7/2000 Yamada ..... G03G 15/0131 198/806
2013/0236224 A1* 9/2013 Matsumoto ..... G03G 15/2053 399/329

(Continued)

FOREIGN PATENT DOCUMENTS

JP 2011-221067 11/2011
JP 2012-208170 10/2012

(Continued)

OTHER PUBLICATIONS

U.S. Appl. No. 14/997,697, filed Jan. 18, 2016.

*Primary Examiner* — Hoang Ngo
(74) *Attorney, Agent, or Firm* — Harness, Dickey & Pierce, P.L.C.

(57) ABSTRACT

A fixing device includes a fixing belt looped over a first roller and a second roller and rotatable in a predetermined direction of rotation and a pressure rotator to press against the first roller via the fixing belt to form a fixing nip between the fixing belt and the pressure rotator. A separation aid, disposed downstream from the fixing nip in the direction of rotation of the fixing belt, contacts an inner circumferential surface of the fixing belt to decrease a radius of curvature of the fixing belt. A polishing roller, disposed downstream from the separation aid and upstream from the second roller in the direction of rotation of the fixing belt, contacts an outer circumferential surface of the fixing belt. An opposed roller, disposed opposite the polishing roller via the fixing belt, forms a polishing nip between the polishing roller and the fixing belt.

17 Claims, 5 Drawing Sheets

(56) References Cited

U.S. PATENT DOCUMENTS

| | | | |
|---|---|---|---|
| 2015/0093128 | A1 | 4/2015 | Okamoto |
| 2015/0261154 | A1 | 9/2015 | Nozawa et al. |
| 2015/0261183 | A1 | 9/2015 | Kikushima et al. |

FOREIGN PATENT DOCUMENTS

| | | |
|---|---|---|
| JP | 2014-134656 | 7/2014 |
| JP | 2014-164074 | 9/2014 |
| JP | 2014-215376 | 11/2014 |
| JP | 2015-087738 | 5/2015 |
| JP | 2015-172620 | 10/2015 |
| JP | 2016-006472 | 1/2016 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2015-085297, filed on Apr. 17, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a first roller, a second roller, and a fixing belt looped over the first roller and the second roller and rotatable in a predetermined direction of rotation. A pressure rotator presses against the first roller via the fixing belt to form a fixing nip between the fixing belt and the pressure rotator, through which a recording medium bearing a toner image is conveyed. A separation aid is disposed in proximity to and downstream from the fixing nip in the direction of rotation of the fixing belt. The separation aid contacts an inner circumferential surface of the fixing belt to decrease a radius of curvature of the fixing belt. A polishing roller is disposed downstream from the separation aid and upstream from the second roller in the direction of rotation of the fixing belt. The polishing roller contacts an outer circumferential surface of the fixing belt. An opposed roller is disposed opposite the polishing roller via the fixing belt to form a polishing nip between the polishing roller and the fixing belt.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a first roller, a second roller, and a fixing belt looped over the first roller and the second roller and rotatable in a predetermined direction of rotation. A pressure rotator presses against the first roller via the fixing belt to form a fixing nip between the fixing belt and the pressure rotator, through which the recording medium bearing the toner image is conveyed. A separation aid is disposed in proximity to and downstream from the fixing nip in the direction of rotation of the fixing belt. The separation aid contacts an inner circumferential surface of the fixing belt to decrease a radius of curvature of the fixing belt. A polishing roller is disposed downstream from the separation aid and upstream from the second roller in the direction of rotation of the fixing belt. The polishing roller contacts an outer circumferential surface of the fixing belt. An opposed roller is disposed opposite the polishing roller via the fixing belt to form a polishing nip between the polishing roller and the fixing belt.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
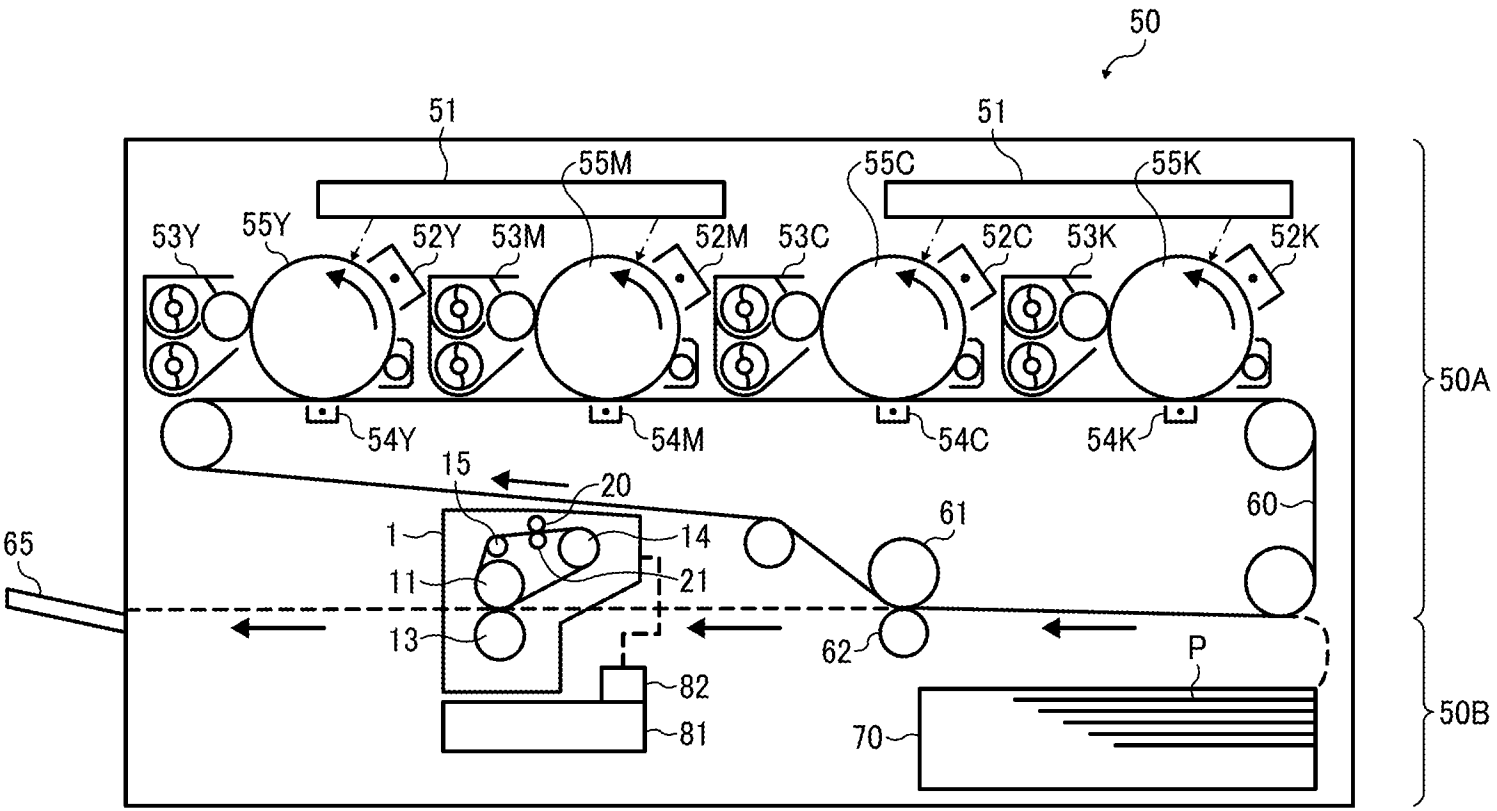
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 50 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 50. The image forming apparatus 50 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 50 is a color copier that forms color and monochrome toner images on recording media by electrophotography. Alternatively, the image forming apparatus 50 may be a monochrome copier that forms a monochrome toner image on a recording medium.

Referring to FIG. 1, a description is provided of a construction of the image forming apparatus 50.

As illustrated in FIG. 1, the image forming apparatus 50 is a tandem color copier. The image forming apparatus 50 configured to convey a recording medium at high speed includes an image forming device 50A situated in a center portion of the image forming apparatus 50, a sheet feeder 50B situated below the image forming device 50A, and an image reader situated above the image forming device 50A.

A detailed description is now given of a construction of the image forming device 50A.

The image forming device 50A includes a fixing device 1.

The image forming device 50A further includes a transfer belt 60 having a transfer face extending horizontally in FIG. 1. An upper face of the transfer belt 60 is disposed opposite components that form toner images in complementary colors created based on separation colors, respectively. For example, photoconductors 55Y, 55M, 55C, and 55K, serving as image bearers that bear yellow, magenta, cyan, and black toner images in the complementary colors, respectively, are aligned along the transfer face of the transfer belt 60. Each of the photoconductors 55Y, 55M, 55C, and 55K is a drum rotatable counterclockwise in FIG. 1 in an identical direction. The photoconductors 55Y, 55M, 55C, and 55K are surrounded by an optical writing device 51, chargers 52Y, 52M, 52C, and 52K, developing devices 53Y, 53M, 53C, and 53K, primary transfer devices 54Y, 54M, 54C, and 54K, and cleaners, respectively, which perform image formation processes as the photoconductors 55Y, 55M, 55C, and 55K rotate.

The developing devices 53Y, 53M, 53C, and 53K contain yellow, magenta, cyan, and black toners, respectively. The transfer belt 60 looped over a driving roller and a plurality of driven rollers is disposed opposite the photoconductors 55Y, 55M, 55C, and 55K and rotatable clockwise in FIG. 1. A roller 61, that is, one of the plurality of driven rollers, is disposed opposite a transfer roller 62 via the transfer belt 60. A conveyance path extends horizontally from the transfer roller 62 to the fixing device 1 to convey a sheet P serving as a recording medium.

A detailed description is now given of a construction of the sheet feeder 50B.

The sheet feeder 50B includes a paper tray 70 that loads a plurality of sheets P serving as recording media and a feed device that separates an uppermost sheet P from other sheets P loaded in the paper tray 70 and conveys the sheet P to the transfer roller 62.

A description is provided of an image forming operation to form a toner image on a sheet P that is performed by the image forming apparatus 50 having the construction described above.

Taking the photoconductor 55Y that forms a yellow toner image, the charger 52Y uniformly changes an outer circumferential surface of the photoconductor 55Y. The optical writing device 51 forms an electrostatic latent image on the photoconductor 55Y according to image data sent from the image reader. The developing device 53Y containing yellow toner visualizes the electrostatic latent image into a yellow toner image. The primary transfer device 54Y applied with a predetermined bias primarily transfers the yellow toner image onto the transfer belt 60. Similarly, magenta, cyan, and black toner images are formed on the photoconductors 55M, 55C, and 55K, respectively, and primarily transferred onto the transfer belt 60 successively by an electrostatic force such that the yellow, magenta, cyan, and black toner images are superimposed on a same position on the transfer belt 60, thus forming a color toner image on the transfer belt 60.

The roller 61 and the transfer roller 62 secondarily transfer the color toner image formed on the transfer belt 60 onto the sheet P conveyed from the paper tray 70. The sheet P bearing the color toner image is conveyed further to the fixing device 1 where the color toner image is fixed on the sheet P as the sheet P passes through the fixing device 1. The sheet P ejected from the fixing device 1 is conveyed to a stacker 65 through an output path.

Figure 2:
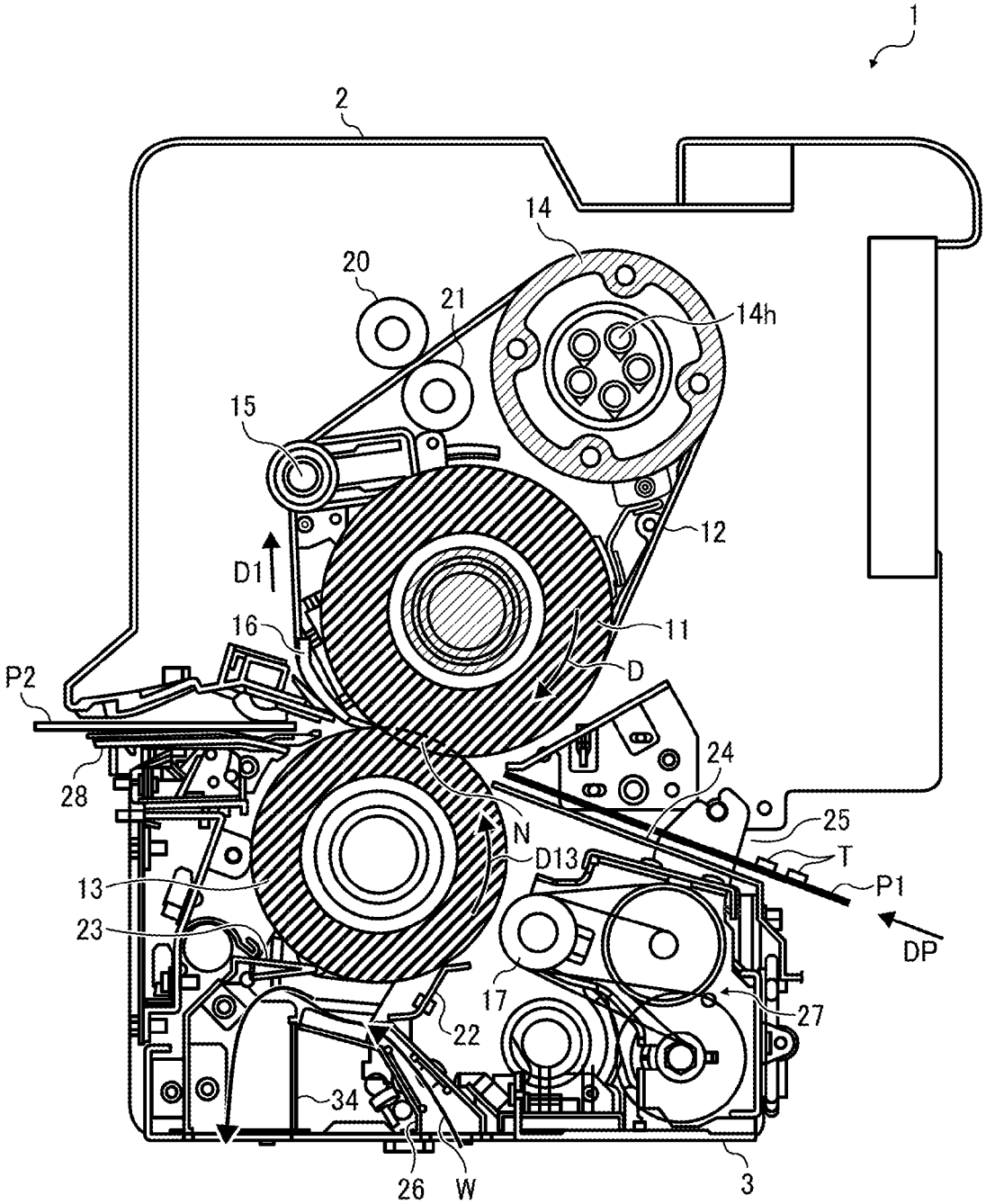
FIG. 2 is a schematic vertical cross-sectional view of a fixing device incorporated in the image forming apparatus illustrated in FIG. 1.
Figure 3:
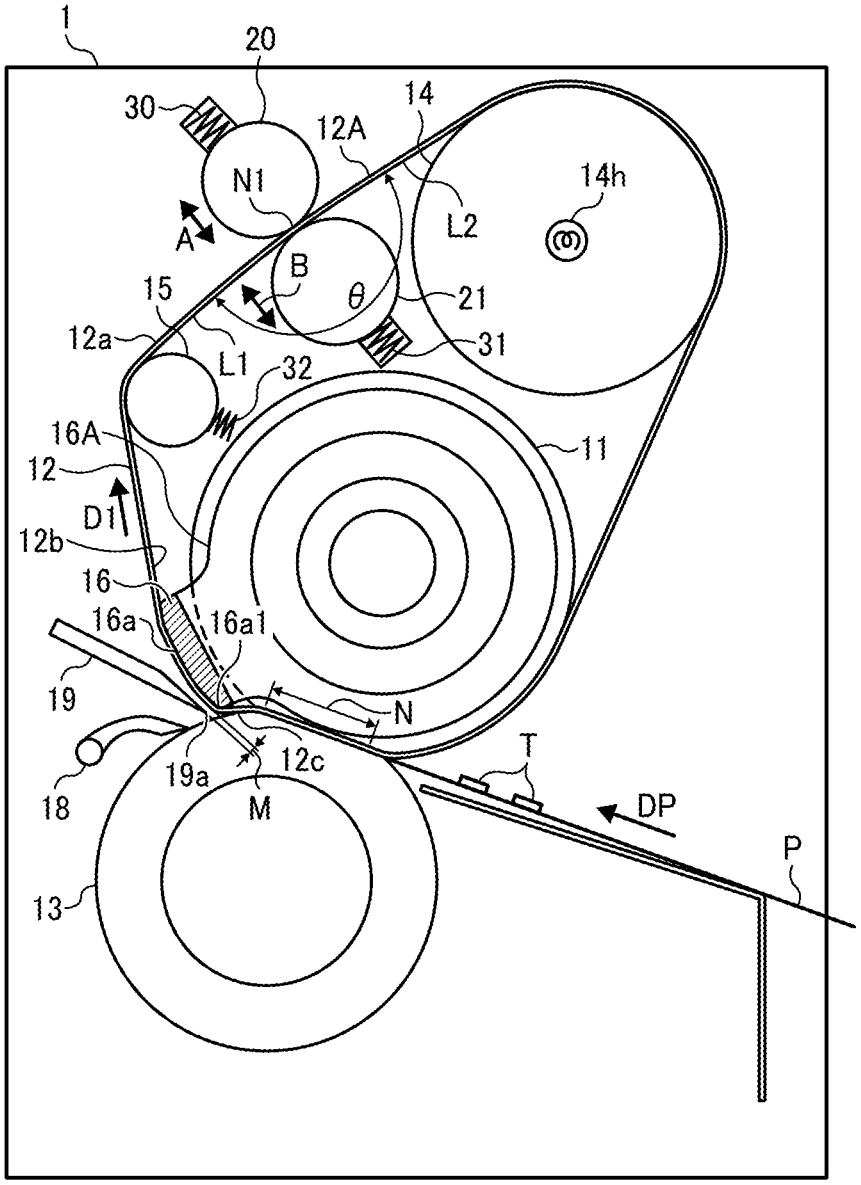
FIG. 3 is a partial schematic vertical cross-sectional view of the fixing device illustrated in FIG. 2.
Figure 4:
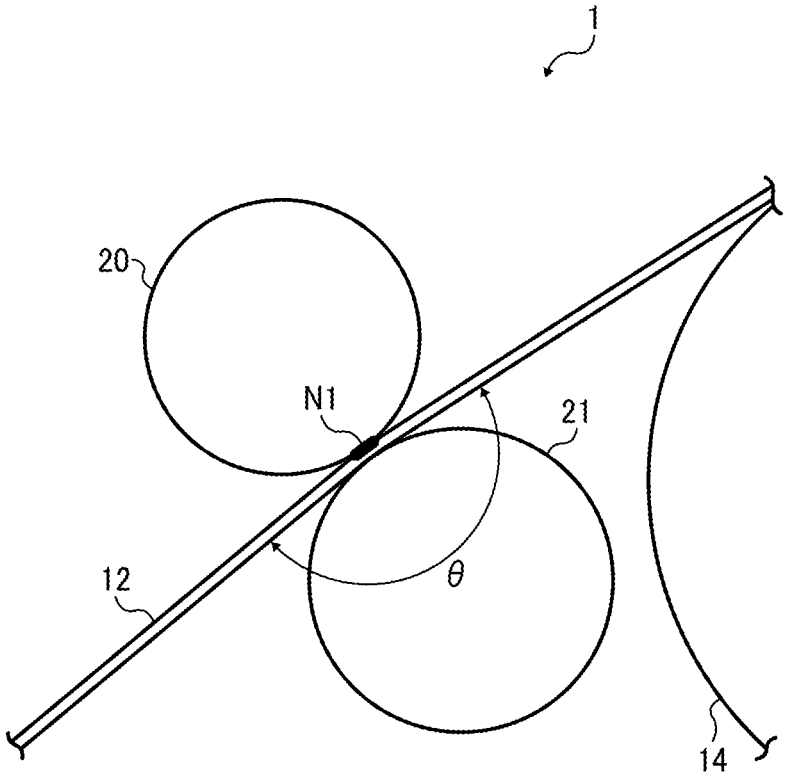
FIG. 4 is a partially enlarged vertical cross-sectional view of the fixing device illustrated in FIG. 3.

Referring to FIGS. 2 to 4, a description is provided of a construction of the fixing device 1 incorporated in the image forming apparatus 50 having the construction described above.

FIG. 2 is a vertical cross-sectional view of the fixing device 1. FIG. 3 is a partial schematic vertical cross-sectional view of the fixing device 1. FIG. 4 is a partially enlarged vertical cross-sectional view of the fixing device 1.

As illustrated in FIGS. 2 and 3, the fixing device 1 (e.g., a fuser or a fusing unit) includes a heating roller 14 serving as a second roller situated in an upper portion of the fixing device 1, a pressure roller 13 serving as a pressure rotator or a pressure member situated in a lower portion of the fixing device 1, a fixing roller 11 serving as a first roller situated in an intermediate portion of the fixing device 1, and a tension roller 15 situated in a left, intermediate portion of the fixing device 1. The fixing device 1 further includes a fixing belt 12 serving as a fixing rotator or a fixing member stretched taut across the heating roller 14, the fixing roller 11, and the tension roller 15 with a predetermined tension. FIGS. 2 and 3 illustrate the fixing device 1 employing a horizontal conveyance system to convey the sheet P horizontally. Alternatively, the fixing device 1 may employ a vertical conveyance system to convey the sheet P vertically, an oblique conveyance system to convey the sheet P obliquely, or other conveyance systems to convey the sheet P in other directions. Accordingly, the position of each of the heating roller 14, the pressure roller 13, the fixing roller 11, the tension roller 15, and the fixing belt 12 is not limited to the position illustrated in FIGS. 2 and 3.

A detailed description is now given of a construction of the pressure roller 13.

The pressure roller 13 is disposed opposite and pressed against the fixing roller 11 via the fixing belt 12 to form a fixing nip N between the pressure roller 13 and the fixing belt 12 while the pressure roller 13 rotates in a rotation direction D13 and the fixing belt 12 rotates in a rotation direction D1. Thus, the fixing belt 12 serves as a first nip formation member and the pressure roller 13 serves as a second nip formation member. The pressure roller 13 includes a metallic body treated with fluorine coating or coated with a fluorine sheet. A separation aid 16 situated immediately downstream from the fixing nip N in the rotation direction D1 of the fixing belt 12 and inside a loop formed by the fixing belt 12 decreases the radius of curvature of the fixing belt 12, facilitating separation of the sheet P from the fixing belt 12.

As illustrated in FIG. 3, the separation aid 16 pressingly contacts an inner circumferential surface 12*b* of the fixing belt 12 with increased pressure at a position in proximity to and downstream from the fixing nip N in the rotation direction D1 of the fixing belt 12 to decrease the radius of curvature of the fixing belt 12. The separation aid 16 includes a curved or substantially curved, outer circumferential face 16*a* that contacts the inner circumferential surface 12*b* of the fixing belt 12. The separation aid 16 is secured to the fixing device 1 through a stationary bracket 16A concentric with the fixing roller 11 and mounting the separation aid 16. The bracket 16A mounts the separation aid 16 such that the separation aid 16 projects outward beyond the fixing roller 11 in a radial direction of the fixing roller 11.

A detailed description is now given of a configuration of a separation plate 19 and a separation claw 18.

As illustrated in FIG. 3, the separation plate 19 serving as a separator is disposed downstream from the fixing nip N in a sheet conveyance direction DP with a slight gap M retained between a front end 19*a* of the separation plate 19 and an outer circumferential surface 12*a* of the fixing belt 12 to separate the sheet P from the fixing belt 12. The front end 19*a* of the separation plate 19 is substantially tapered to define a front edge. The separation claw 18 is situated below and adjacent to the separation plate 19 in FIG. 3. The separation claw 18 is disposed downstream from the fixing nip N in the sheet conveyance direction DP to prevent the sheet P from being wound around the pressure roller 13. The sheet P is conveyed leftward in FIG. 3 through an interval between the separation plate 19 and the separation claw 18 and ejected leftward from the fixing device 1. It is to be noted that directions defined by upward, downward, leftward, rightward, frontward, rearward, vertically, horizontally, and obliquely are used with reference to the drawings and therefore do not limit the location and the construction of the fixing device 1.

A detailed description is now given of a construction of the fixing belt 12, the fixing roller 11, and the heating roller 14.

The fixing belt 12 is a double layered endless belt in cross-section constructed of a base layer made of nickel, stainless steel, polyimide, or the like and an elastic layer made of silicone rubber or the like. The fixing roller 11 is constructed of a cored bar made of metal and an elastic layer coating the cored bar and made of silicone rubber or the like. Alternatively, the elastic layer may be made of silicone rubber foam to reduce heat absorbed into the fixing belt 12 and thereby shorten a warm-up time to warm up the fixing belt 12 to a target temperature. The heating roller 14 is a hollow roller made of aluminum or iron and accommodating a heater 14*h* (e.g., a halogen heater) serving as a heater or a heat source. Alternatively, an induction heater (IH) may be used as a heater or a heat source that heats the fixing belt 12.

As illustrated in FIG. 2, a driver drives and rotates the fixing roller 11 clockwise in a rotation direction D. The fixing roller 11 in turn rotates the fixing belt 12 clockwise in the rotation direction D1 by friction between the fixing roller 11 and the fixing belt 12 while a spring 32 biases the tension roller 15 against the fixing belt 12 such that the tension roller 15 exerts an appropriate tension outward to the fixing belt 12. Thus, the fixing belt 12 ejects the sheet P illustrated as a sheet P2 in FIG. 2 from the fixing nip N. While the sheet P is conveyed through the fixing device 1 for a fixing job, a pressurization assembly presses the pressure roller 13 against the fixing belt 12 to form the fixing nip N therebetween. Conversely, while the fixing device 1 is in a standby mode to wait for the fixing job, the pressurization assembly moves the pressure roller 13 downward in FIG. 2 to separate the pressure roller 13 from the fixing belt 12.

When the fixing device 1 receives the fixing job, the heater 14*h* disposed inside the heating roller 14 heats the fixing belt 12 through the heating roller 14 to a predetermined temperature (e.g., a fixing temperature appropriate to fix a toner image T on a sheet P) that is detected by a temperature detector such as a thermistor disposed inside the fixing device 1. The pressure roller 13 is a tube constructed of a cored bar made of aluminum, iron, or the like and an elastic layer coating the cored bar and made of silicone rubber or the like.

The pressurization assembly moves the pressure roller 13 toward the fixing belt 12 to press the pressure roller 13 against the fixing belt 12 and moves the pressure roller 13 away from the fixing belt 12 to release pressure exerted by the pressure roller 13 to the fixing belt 12. As the fixing device 1 is actuated, the pressurization assembly presses the pressure roller 13 against the fixing belt 12 with predetermined pressure.

According to this exemplary embodiment, the pressure roller 13 is used as a pressure rotator. Alternatively, an endless belt looped over a plurality of rollers (e.g., two rollers) may be used as a pressure rotator. The pressure roller 13 is pressed against the fixing roller 11 via the fixing belt 12 to form the fixing nip N between the pressure roller 13 and the fixing belt 12.

While the fixing belt 12 and the pressure roller 13 are driven and rotated in the rotation directions D1 and D13, respectively, the outer circumferential surface 12*a* of the fixing belt 12 is heated to the predetermined temperature. As the sheet P bearing the unfixed toner image T is conveyed through the fixing nip N leftward in FIG. 2 in the sheet conveyance direction DP, the fixing belt 12 and the pressure roller 13 apply heat and pressure to the sheet P at the fixing nip N, melting and fixing the toner image T on the sheet P.

The sheet P bearing the fixed toner image T is ejected leftward in FIG. 2 from the fixing nip N. The separation aid 16 disposed inside the loop formed by the fixing belt 12 and disposed downstream from the fixing nip N in the rotation direction D1 of the fixing belt 12 produces a decreased radius of curvature of the fixing belt 12. The decreased radius of curvature of the fixing belt 12 separates a leading edge of the sheet P from the fixing belt 12 by a distance equivalent to the slight gap M depicted in FIG. 3. Thus, the separation aid 16 separates the sheet P from the fixing belt 12.

As illustrated in FIG. 3, the fixing belt 12 includes a curved projection 12*c* projecting beyond an outer circumferential surface of the fixing roller 11 outward in the radial direction of the fixing roller 11. The projection 12*c* is contoured horizontally or obliquely downward from an exit of the substantially planar fixing nip N tilted slightly left upward along a lower, upstream portion 16*a*1 in the rotation direction D1 of the outer circumferential face 16*a* of the separation aid 16. The sheet P ejected from the fixing nip N is conveyed along the projection 12*c* of the fixing belt 12, separated from the fixing belt 12, and conveyed substantially horizontally as the sheet P2 illustrated in FIG. 2. FIG. 2 illustrates a sheet P1 as a sheet P before entering the fixing nip N and the sheet P2 as a sheet P ejected from the fixing nip N.

A description is provided of a construction of a comparative fixing device.

The comparative fixing device includes a fixing roller, a heating roller, a fixing belt looped over the fixing roller and the heating roller, a pressure roller disposed opposite the fixing roller and in contact with the fixing belt, and a polishing roller.

A cam moves the polishing roller via a spring to bring the polishing roller into contact with the fixing belt and separate the polishing roller from the fixing belt looped over the fixing roller. As the polishing roller slides over a surface of the fixing belt, the polishing roller polishes the fixing belt.

While a sheet is conveyed through a fixing nip formed between the fixing belt and the pressure roller, burrs produced on the sheet by cutting may scratch and damage the surface of the fixing belt, resulting in abrasion of the fixing belt. If a large sheet spanning scratches on the fixing belt is conveyed through the fixing nip, the scratches on the fixing belt may damage a toner image on the sheet. To address this circumstance, the polishing roller polishes the surface of the fixing belt.

Under an increased consciousness of environmental issues, the comparative fixing device is requested to enhance usability of thin paper containing a decreased amount of pulp and generating a decreased amount of carbon dioxide, convey recording media of various types such as thin paper and thick paper at high speed, and improve durability of the fixing belt.

For example, the pressure roller having an increased rigidity greater than a rigidity of the fixing roller is pressed against the fixing roller serving as an elastic body disposed inside a loop formed by the fixing belt to decrease the curvature of the fixing belt at an exit of the fixing nip so as to separate the sheet from the fixing belt. However, such configuration does not separate soft thin paper precisely. For example, as the fixing roller is enlarged to convey the sheet at high speed, the thin paper may not separate from the fixing belt readily. To address this circumstance, a separation aid that defines the curvature of the fixing belt is disposed downstream from the fixing nip in a sheet conveyance direction.

The polishing roller configured to polish the surface of the fixing belt that suffers from abrasion caused by the burrs on the sheet is disposed opposite the fixing roller via the fixing belt. However, the linear velocity of the fixing belt may fluctuate between an upstream position upstream from the separation aid and a downstream position downstream from the separation aid in the sheet conveyance direction. Accordingly, the polishing roller disposed opposite the fixing roller may not polish the fixing belt precisely.

As illustrated in FIGS. 2 and 3, an opposed roller 21 is interposed between the tension roller 15 and the heating roller 14 in the rotation direction D1 of the fixing belt 12 and disposed inside the loop formed by the fixing belt 12 looped over the tension roller 15 and the heating roller 14. A polishing roller 20 is disposed opposite the opposed roller 21 via the fixing belt 12. The polishing roller 20 is disposed outside the loop formed by the fixing belt 12 and in contact with the outer circumferential surface 12*a* of the fixing belt 12. As illustrated in FIG. 3, the opposed roller 21 disposed inside the loop formed by the fixing belt 12 and the polishing roller 20 disposed outside the loop formed by the fixing belt 12 contact the fixing belt 12 at an intermediate position disposed substantially at a half of a circumferential span 12A of the fixing belt 12 defined by the tension roller 15 and the heating roller 14 in the rotation direction D1 of the fixing belt 12. The polishing roller 20 contacts the outer circumferential surface 12*a* of the fixing belt 12 at a position disposed downstream from the separation aid 16 and upstream from the heating roller 14 in the rotation direction D1 of the fixing belt 12. As the polishing roller 20 slides over the outer circumferential surface 12*a* of the fixing belt 12, the polishing roller 20 polishes the outer circumferential surface 12*a* of the fixing belt 12. As illustrated in FIG. 4, the opposed roller 21 and the polishing roller 20 form a polishing nip N1 between the polishing roller 20 and the fixing belt 12.

Even if the linear velocity of the fixing belt 12 fluctuates between a position relatively in proximity to and upstream from the separation aid 16 and a position relatively in proximity to and downstream from the separation aid 16 in the rotation direction D1 of the fixing belt 12, the polishing roller 20 polishes the fixing belt 12 in a state in which the opposed roller 21 presses the fixing belt 12 against the polishing roller 20 at a position disposed upstream from the separation aid 16 in the rotation direction D1 of the fixing belt 12 where the fixing belt 12 achieves a stable linear velocity. Accordingly, the polishing roller 20 polishes the fixing belt 12 stably and sufficiently, suppressing faulty polishing of the fixing belt 12.

Additionally, since the fixing belt 12 moves toward the polishing nip N1 while contacting the tension roller 15 disposed downstream from the separation aid 16 in the rotation direction D1 of the fixing belt 12, the tension roller 15 stabilizes the linear velocity of the fixing belt 12. While the fixing belt 12 moves in the circumferential span 12A defined between the tension roller 15 and the heating roller 14 at the stabilized linear velocity, the polishing roller 20 polishes the fixing belt 12 pressed against the opposed roller 21. Accordingly, the polishing roller 20 polishes the fixing belt 12 more stably and sufficiently, further suppressing faulty polishing of the fixing belt 12. Consequently, the polishing roller 20 retains stable polishing of the fixing belt 12, improving separation of the sheet P from the fixing belt 12 and quality of the toner image T fixed on the sheet P.

As illustrated in FIG. 3, a bend angle θ of the fixing belt 12 is defined by the opposed roller 21, the tension roller 15, and the heating roller 14 as the opposed roller 21 bends the fixing belt 12 looped over the tension roller 15, the opposed roller 21, and the heating roller 14. The bend angle θ is smaller than 180 degrees. The bend angle θ is smaller than 180 degrees because linear pressure is exerted from the polishing roller 20 to the fixing belt 12 at the polishing nip N1 formed between the polishing roller 20 and the fixing belt 12 contacting the opposed roller 21 as illustrated in FIG. 4, thus achieving stable polishing. Consequently, the polishing roller 20 retains stable polishing of the fixing belt 12, improving separation of the sheet P from the fixing belt 12 and quality of the toner image T fixed on the sheet P. For example, if the bend angle θ of the fixing belt 12 is 180 degrees or greater than 180 degrees, the area of the polishing nip N1 increases and pressure exerted from the polishing roller 20 to the fixing belt 12 disperses, destabilizing polishing.

According to this exemplary embodiment, the bend angle θ is 170 degrees, for example. Alternatively, the bend angle θ may be about 170 degrees, for example, in a range of from about 165 degrees to about 175 degrees. Yet alternatively, the bend angle θ may be 170 degrees or smaller. However if the bend angle θ is an acute angle, the fixing belt 12 may suffer from degradation in durability. Hence, it is preferable that the bend angle θ is an obtuse angle.

The bend angle θ of the fixing belt 12 created by the opposed roller 21, the tension roller 15, and the heating roller 14 is defined as below. As illustrated in FIG. 3, the bend angle θ is a crossing angle (e.g., an inner angle) defined by a first straight line L1 bridging an outer circumferential surface of the tension roller 15 and an outer circumferential surface of the opposed roller 21 in a tangential direction and a second straight line L2 bridging an outer circumferential surface of the heating roller 14 and the outer circumferential surface of the opposed roller 21 in the tangential direction along a trajectory of the fixing belt 12.

Figure 5:
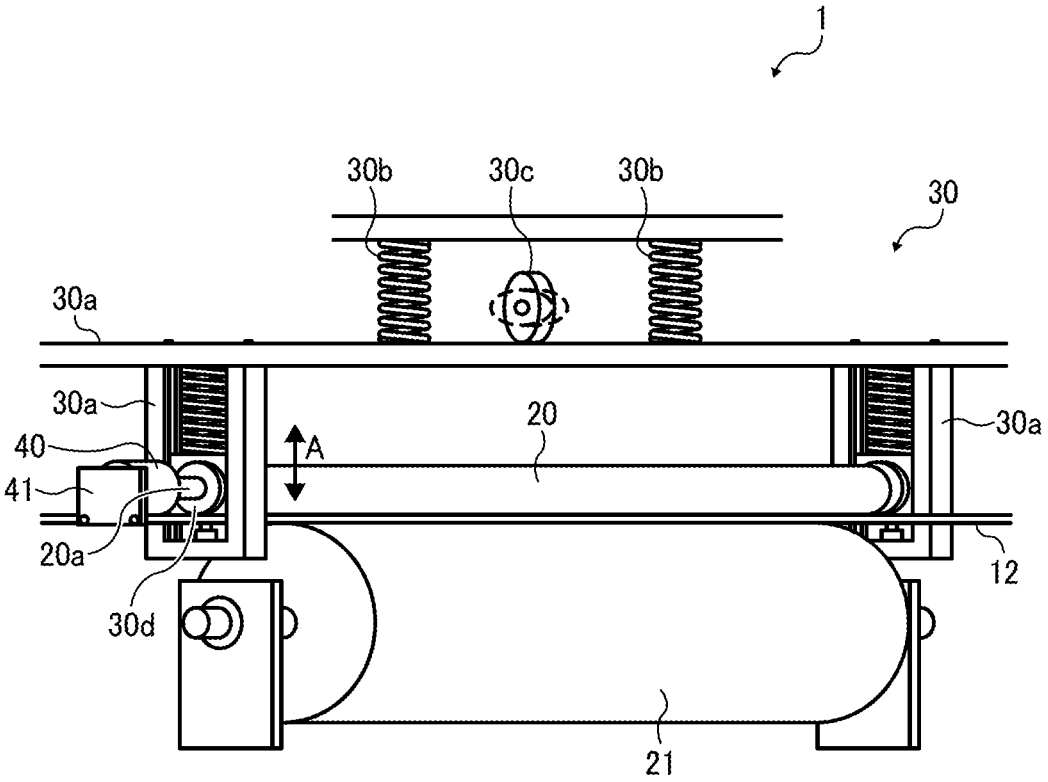
FIG. 5 is a perspective view of the fixing device illustrated in FIG. 3.

FIG. 5 is a perspective view of the fixing device 1 for explaining a construction of a mover 30 that moves the polishing roller 20. As illustrated in FIGS. 3 and 5, the mover 30 serving as a first mover coupled with the polishing roller 20 moves the polishing roller 20 to come into contact with and separate from the fixing belt 12 in a direction A. For example, as illustrated in FIG. 5, the mover 30 includes a frame 30*a* coupled with the polishing roller 20, springs 30*b* anchored to the frame 30*a*, and a cam 30*c* contacting the frame 30*a*. A bearing 30*d* rotatably supporting a shaft 20*a* of the polishing roller 20 engages the frame 30*a* such that the bearing 30*d* is slidable in the direction A. The bearing 30*d* is attached with a motor mount 41 that mounts a motor 40. The motor 40 is coupled with the shaft 20*a* of the polishing roller 20 to drive and rotate the polishing roller 20. As the cam 30*c* rotates, the cam 30*c* moves the frame 30*a* which in turn moves the polishing roller 20 in the direction A to cause the polishing roller 20 to come into contact with and separate from the fixing belt 12.

Similarly, as illustrated in FIG. 3, a mover 31 serving as a second mover coupled with the opposed roller 21 moves the opposed roller 21 to come into contact with and separate from the fixing belt 12 in a direction B. The mover 31 has a construction equivalent to the construction of the mover 30 illustrated in FIG. 5.

Alternatively, an identical mover may move the polishing roller 20 and the opposed roller 21 with respect to the fixing belt 12 simultaneously. For example, the mover may bring the polishing roller 20 and the opposed roller 21 into contact with the fixing belt 12 simultaneously and may separate the polishing roller 20 and the opposed roller 21 from the fixing belt 12 simultaneously. The opposed roller 21 may contact the fixing belt 12 constantly. However, it is preferable that the opposed roller 21 separably contacts the fixing belt 12 to decrease friction between the opposed roller 21 and the fixing belt 12. Alternatively, the opposed roller 21 may move with respect to the fixing belt 12 to a close position where the opposed roller 21 is in proximity to the fixing belt 12 with a decreased interval therebetween and an isolation position where the opposed roller 21 is isolated from the fixing belt 12 with an increased interval therebetween.

While the polishing roller 20 is not requested to polish the fixing belt 12, the polishing roller 20 is separated from the fixing belt 12 to extend the life of the fixing belt 12. Consequently, the polishing roller 20 retains stable polishing of the fixing belt 12, improving separation of the sheet P from the fixing belt 12 and quality of the toner image T fixed on the sheet P.

Like the fixing roller 11, the heating roller 14, or the pressure roller 13, the polishing roller 20 and the opposed roller 21 are parallel to each other and extend horizontally in an axial direction of the polishing roller 20 and the opposed roller 21. A length of the polishing roller 20 in the axial direction thereof is greater than a length of the opposed roller 21 in the axial direction thereof. Accordingly, the polishing roller 20 is pressed against the opposed roller 21 via the fixing belt 12 throughout the entire width of the opposed roller 21 in the axial direction thereof. The polishing roller 20 precisely and sufficiently polishes the outer circumferential surface 12*a* of the fixing belt 12 that comes into contact with an imaged side of the sheet P that bears the unfixed toner image T and conveys the sheet P in the sheet conveyance direction DP. Consequently, the polishing roller 20 retains stable polishing of the fixing belt 12, improving separation of the sheet P from the fixing belt 12 and quality of the toner image T fixed on the sheet P.

A description is provided of a configuration of other components of the fixing device 1 depicted in FIG. 2.

The fixing device 1 is installed in a printer employing an electrophotographic method, for example. As illustrated in FIG. 2, the fixing device 1 includes an upper cover 2 and a lower cover 3 that accommodate the heating roller 14, the fixing roller 11, and the pressure roller 13 which are aligned in this order obliquely left downward. The heating roller 14 accommodates the heater 14*h* constructed of a plurality of heaters. The pressurization assembly biases and presses the pressure roller 13 obliquely upward against the fixing roller 11 to form the fixing nip N between the pressure roller 13 and the fixing belt 12, thus moving the pressure roller 13 radially from an isolation position where the pressure roller 13 is isolated from the fixing belt 12 to a fixing position illustrated in FIG. 2 where the pressure roller 13 contacts the fixing belt 12 to fix the toner image T on the sheet P. For example, the pressurization assembly may be a cam and a spring, a plunger, or the like to move the pressure roller 13 to bias the pressure roller 13 against the fixing roller 11.

An upstream, entry sheet guide plate 24, that is, a right sheet guide plate in FIG. 2 disposed upstream from the fixing nip N in the sheet conveyance direction DP, is angled left upward and directed to the fixing nip N formed between the pressure roller 13 and the fixing belt 12. Conversely, a downstream, exit sheet guide plate 28, that is, a left sheet guide plate in FIG. 2 disposed downstream from the fixing nip N in the sheet conveyance direction DP and in proximity to the exit of the fixing nip N, extends substantially horizontally. FIG. 2 illustrates the sheet P1 serving as a recording medium conveyed over an upper face of the entry sheet guide plate 24 and the sheet P2 serving as a recording medium conveyed over an upper face of the exit sheet guide plate 28. The sheets P1 and P2 are one example of recording media conveyed through the fixing device 1 and equivalent to the sheet P depicted in FIGS. 1 and 3.

The separation aid 16 curved in cross-section is disposed downstream from the fixing nip N in the sheet conveyance direction DP on the left of the fixing nip N in FIG. 2. The separation aid 16 is angled obliquely upward and directed to the tension roller 15. The fixing belt 12, the fixing roller 11, the heating roller 14, the tension roller 15, the polishing roller 20, and the opposed roller 21 are housed by the upper cover 2. The pressure roller 13 is housed by the lower cover 3. A sheet conveyance path 25 is produced between the upper cover 2 and the lower cover 3.

A left, front edge of the right, entry sheet guide plate 24 is in proximity to the outer circumferential surface of a right upper part of the pressure roller 13. The right, entry sheet guide plate 24 constitutes a part, that is, an upper wall, of the lower cover 3. Multiple rollers 27 that constitute a cleaning web unit, for example, are located in a space below the right, entry sheet guide plate 24. The multiple rollers 27 include a roller 17 having a decreased diameter that is in proximity to the outer circumferential surface of a right part of the pressure roller 13.

A right, front end of the left, exit sheet guide plate 28 is bent obliquely downward to produce a bent portion disposed in proximity to the pressure roller 13. The left, exit sheet guide plate 28 is mounted on or secured to the lower cover 3. Below the left, exit sheet guide plate 28 is a rectification plate 23. A right, front end of the rectification plate 23 contacts the outer circumferential surface of a left lower part of the pressure roller 13.

On the right of the rectification plate 23 and a lower end of the pressure roller 13 is another rectification plate 22 angled right upward. An upper end of the rectification plate 22 contacts the outer circumferential surface of a right lower part of the pressure roller 13. Below the right rectification plate 22 is an inlet to take in air. The inlet penetrates through a bottom wall of the lower cover 3. A cooling duct 26 extends from the inlet obliquely left upward toward the lower end of the pressure roller 13. An exhaust duct 34 is on the left of the cooling duct 26 and adjoins the cooling duct 26. For example, the lower cover 3 accommodates a temperature sensor serving as a temperature detector that detects the temperature of the pressure roller 13. The temperature sensor projects upward from an upper face of the left rectification plate 23. Additionally, cooling air travels along the outer circumferential surface of the pressure roller 13 in a direction W effectively, thus cooling the pressure roller 13.

As illustrated in FIG. 1, oil applicators 81 and 82 apply oil in an appropriate amount to the fixing belt 12 and the pressure roller 13, respectively. As illustrated in FIG. 3, the separation aid 16 and the separation claw 18 disposed downstream from the fixing nip N in the sheet conveyance direction DP or the rotation direction D1 of the fixing belt 12 prevent the sheet P from being wound around the fixing belt 12 and the pressure roller 13, ejecting the sheet P from a downstream section, that is, the exit, of the fixing nip N.

The fixing device 1 and the image forming apparatus 50 incorporating the fixing device 1 improve fixing performance to fix the toner image T on the sheet P and separation of the sheet P from the fixing belt 12 for various types of the sheet P and the toner image T formed on the sheet P. Additionally, the image forming apparatus 50 and the fixing device 1 are downsized while stabilizing separation of the sheet P from the fixing belt 12, improving quality of the toner image T formed on the sheet P, and enhancing durability of the fixing belt 12. Consequently, the image forming apparatus 50 and the fixing device 1 retain stable polishing of the fixing belt 12, improving separation of the sheet P from the fixing belt 12 and quality of the toner image T fixed on the sheet P.

The construction and the configuration of the image forming apparatus 50 and the fixing device 1 are not limited to those of the exemplary embodiments described above with reference to the drawings.

A description is provided of advantages of the fixing device 1.

As illustrated in FIG. 3, a fixing device (e.g., the fixing device 1) includes a first roller (e.g., the fixing roller 11), a second roller (e.g., the heating roller 14), a fixing belt (e.g., the fixing belt 12) looped over the first roller and the second roller and rotatable in a predetermined direction of rotation (e.g., the rotation direction D1), and a pressure rotator (e.g., the pressure roller 13) to press against the first roller via the fixing belt to form the fixing nip N between the fixing belt and the pressure rotator, through which a recording medium (e.g., the sheet P) bearing a toner image (e.g., the toner image T) is conveyed. The fixing device further includes a separation aid (e.g., the separation aid 16) disposed in proximity to and downstream from the fixing nip N in the direction of rotation of the fixing belt. The separation aid contacts the inner circumferential surface 12*b* of the fixing belt to decrease the radius of curvature of the fixing belt. The fixing device further includes a polishing roller (e.g., the polishing roller 20) disposed downstream from the separation aid and upstream from the second roller in the direction of rotation of the fixing belt. The polishing roller contacts the outer circumferential surface 12*a* of the fixing belt. The fixing device further includes an opposed roller (e.g., the opposed roller 21) disposed opposite the polishing roller via the fixing belt to form the polishing nip N1 between the polishing roller and the fixing belt.

Accordingly, even if the fixing device incorporates the separation aid, the polishing roller polishes the fixing belt while suppressing polishing failure.

According to the exemplary embodiments described above, the fixing belt 12 serves as a fixing belt. Alternatively, a fixing film, a fixing sleeve, or the like may be used as a fixing belt. Further, the pressure roller 13 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a first roller;

a second roller;

a fixing belt looped over the first roller and the second roller and rotatable in a set direction of rotation;

a pressure rotator configured to be pressed against the first roller via the fixing belt to form a fixing nip between the fixing belt and the pressure rotator, the fixing nip through which a recording medium bearing a toner image is conveyed;

a separation aid in proximity to and downstream from the fixing nip in the direction of rotation of the fixing belt, the separation aid contacting an inner circumferential surface of the fixing belt to decrease a radius of curvature of the fixing belt;

a polishing roller downstream from the separation aid and upstream from the second roller in the direction of rotation of the fixing belt, the polishing roller contacting an outer circumferential surface of the fixing belt; and an opposed roller opposite the polishing roller via the fixing belt to form a polishing nip between the polishing roller and the fixing belt, wherein a length of the polishing roller in an axial direction of the polishing roller is greater than a length of the opposed roller in an axial direction of the opposed roller.

2. The fixing device according to claim 1, further comprising a tension roller, downstream from the separation aid in the direction of rotation of the fixing belt, to exert tension to the fixing belt, wherein the polishing roller is interposed between the tension roller and the second roller in the direction of rotation of the fixing belt.

3. The fixing device according to claim 2, wherein the opposed roller and the polishing roller contact the fixing belt at a position at a half of a circumferential span of the fixing belt defined by the tension roller and the second roller in the direction of rotation of the fixing belt.

4. The fixing device according to claim 2, wherein the opposed roller bends the fixing belt to form a bend angle defined by the opposed roller, the tension roller, and the second roller.

5. The fixing device according to claim 4, wherein the bend angle is a crossing angle defined by a first straight line bridging an outer circumferential surface of the tension roller and an outer circumferential surface of the opposed roller in a tangential direction along a trajectory of the fixing belt and a second straight line bridging an outer circumferential surface of the second roller and the outer circumferential surface of the opposed roller in the tangential direction.

6. The fixing device according to claim 1, wherein the opposed roller bends the fixing belt at a bend angle smaller than 180 degrees.

7. The fixing device according to claim 1, further comprising a first mover coupled with the polishing roller to move the polishing roller to come into contact with and separate from the fixing belt.

8. The fixing device according to claim 1, further comprising a second mover coupled with the opposed roller to move the opposed roller to come into contact with and separate from the fixing belt.

9. The fixing device according to claim 1, wherein the separation aid includes a curved outer circumferential face contacting the inner circumferential surface of the fixing belt.

10. The fixing device according to claim 9, wherein the fixing belt includes a curved projection projecting beyond an outer circumferential surface of the first roller in a radial direction of the first roller.

11. The fixing device according to claim 10, wherein the projection of the fixing belt is contoured from an exit of the fixing nip along the outer circumferential face of the separation aid in the direction of rotation of the fixing belt.

12. The fixing device according to claim 1, wherein the pressure rotator includes a pressure roller.

13. The fixing device according to claim 1, further comprising a stationary bracket being concentric with the first roller and mounting the separation aid.

14. The fixing device according to claim 13, wherein the bracket mounts the separation aid to project beyond the first roller in a radial direction of the first roller.

15. A fixing device comprising a first roller;

a second roller;

a fixing belt looped over the first roller and the second roller and rotatable in a set direction of rotation;

a pressure rotator configured to be pressed against the first roller via the fixing belt to form a fixing nip between the fixing belt and the pressure rotator, the fixing nip through which a recording medium bearing a toner image is conveyed;

a separation aid in proximity to and downstream from the fixing nip in the direction of rotation of the fixing belt, the separation aid contacting an inner circumferential surface of the fixing belt to decrease a radius of curvature of the fixing belt;

a polishing roller downstream from the separation aid and upstream from the second roller in the direction of rotation of the fixing belt, the polishing roller contacting an outer circumferential surface of the fixing belt;

an opposed roller opposite the polishing roller via the fixing belt to form a polishing nip between the polishing roller and the fixing belt; and a stationary bracket being concentric with the first roller and mounting the separation aid.

16. The fixing device according to claim 15, wherein the bracket mounts the separation aid to project beyond the first roller in a radial direction of the first roller.

17. An image forming apparatus comprising:

an image bearer to bear a toner image; and a fixing device downstream from the image bearer in a recording medium conveyance direction to fix the toner image on a recording medium, the fixing device including:

a first roller;

a second roller;

a fixing belt looped over the first roller and the second roller and rotatable in a set direction of rotation;

a pressure rotator to press against the first roller via the fixing belt to form a fixing nip between the fixing belt and the pressure rotator, the fixing nip through which the recording medium bearing the toner image is conveyed;

a separation aid in proximity to and downstream from the fixing nip in the direction of rotation of the fixing belt, the separation aid contacting an inner circumferential surface of the fixing belt to decrease a radius of curvature of the fixing belt;

a polishing roller downstream from the separation aid and upstream from the second roller in the direction of rotation of the fixing belt, the polishing roller contacting an outer circumferential surface of the fixing belt; and an opposed roller opposite the polishing roller via the fixing belt to form a polishing nip between the polishing roller and the fixing belt, wherein a length of the polishing roller in an axial direction of the polishing roller is greater than a of the opposed roller in an axial direction of the opposed roller.

* * * * *